US011679908B2

(12) United States Patent
Bevier

(10) Patent No.: US 11,679,908 B2
(45) Date of Patent: Jun. 20, 2023

(54) TRAY WITH NESTING ANTI-LOCK FEATURE

(71) Applicant: INTERNATIONAL PAPER COMPANY, Memphis, TN (US)

(72) Inventor: Alex Dean Bevier, Fresno, CA (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 8 days.

(21) Appl. No.: 16/993,767

(22) Filed: Aug. 14, 2020

(65) Prior Publication Data

US 2022/0048672 A1 Feb. 17, 2022

(51) Int. Cl.

| | |
|---|---|
| ***B65D 21/02*** | (2006.01) |
| ***B65D 5/28*** | (2006.01) |
| ***B65D 5/42*** | (2006.01) |

(52) U.S. Cl.

CPC ..... *B65D 21/0233* (2013.01); *B65D 5/28* (2013.01); *B65D 5/4295* (2013.01)

(58) Field of Classification Search

CPC .... B65D 21/0233; B65D 5/28; B65D 5/0015; B65D 5/003; B65D 5/0055; B65D 5/20; B65D 5/2038; B65D 5/2047; B65D 5/2052; B65D 5/2057; B65D 5/22; B65D 5/24; B65D 5/242; B65D 5/241; B65D 5/244; B65D 5/245; B65D 5/247; B65D 5/26; B65D 5/30

USPC ..... 206/519, 515, 518

See application file for complete search history.

(56) References Cited

U.S. PATENT DOCUMENTS

| | | | | |
|---|---|---|---|---|
| 676,015 A | | 6/1901 | Webb | |
| 779,135 A | | 1/1905 | Reinhold | |
| 1,041,872 A | * | 10/1912 | Regenstein | B65D 5/302 229/195 |
| 2,532,808 A | | 12/1950 | Grinnell | |
| 3,119,540 A | | 1/1964 | Schenk et al. | |

(Continued)

FOREIGN PATENT DOCUMENTS

| | | |
|---|---|---|
| EP | 0270551 A1 | 6/1988 |
| WO | WO-198702008 | 4/1987 |

OTHER PUBLICATIONS

Youtube, Folded Space Basic Tray Assembly Guide. Published Apr. 27, 2020 by Folded Space, Visited Mar. 1, 2022. https://www.youtube.com/watch?v=M7WRDVREw2k (Year: 2020).

(Continued)

*Primary Examiner* — Robert Poon

(74) *Attorney, Agent, or Firm* — Michael D. Folkerts; Thomas W. Ryan

(57) ABSTRACT

A container including a bottom portion and a plurality of peripheral wall portions extending from the bottom portion and defining an interior area of the container. At least one peripheral wall portion has an inner surface including a feature defining an inner ledge extending into the interior area, the inner ledge being located between the bottom portion and an upper edge of the container. The at least one peripheral wall portion has an outer surface including a feature defining an outer ledge located between the bottom portion and the upper edge of the container. The inner ledge is positioned to engage the outer ledge of a similarly-configured container whereby a spacing between a stack of nested containers is defined by the outer ledge of the similarly-configured container seated on the inner ledge of the container.

18 Claims, 5 Drawing Sheets

(56) References Cited

U.S. PATENT DOCUMENTS

| | | | | | |
|---|---|---|---|---|---|
| 3,572,576 | A * | 3/1971 | Foster | B65D 5/5455 | 229/160 |
| 3,765,592 | A | 10/1973 | Chadbourne | | |
| 4,304,352 | A | 12/1981 | Humphries | | |
| 4,631,046 | A | 12/1986 | Kennedy | | |
| D311,336 | S | 10/1990 | Haraldsson | | |
| 5,020,717 | A * | 6/1991 | Cassidy | B65D 5/667 | 229/114 |
| 5,029,750 | A | 7/1991 | Artusi | | |
| D319,940 | S | 9/1991 | Ehlebracht | | |
| 5,086,971 | A * | 2/1992 | Detzel | B65D 5/2047 | 229/188 |
| 5,114,034 | A * | 5/1992 | Miller | B65D 5/443 | 229/114 |
| 5,265,796 | A | 11/1993 | Gulliver et al. | | |
| 5,335,770 | A | 8/1994 | Baker | | |
| 5,402,932 | A * | 4/1995 | Fadaie | B65D 5/302 | 229/197 |
| 5,639,019 | A | 6/1997 | Mayled | | |
| 5,855,317 | A * | 1/1999 | Dalrymple | B65D 5/6661 | 493/151 |
| D434,653 | S | 12/2000 | Maguire | | |
| 6,269,967 | B1 * | 8/2001 | de Vries | B65D 43/0218 | 220/669 |
| 6,505,769 | B2 | 1/2003 | Stone | | |
| D631,743 | S | 2/2011 | Hubbard, Jr. et al. | | |
| D714,139 | S | 9/2014 | Genender | | |
| D720,989 | S | 1/2015 | Genender et al. | | |
| D847,610 | S | 5/2019 | Bevier | | |
| D885,913 | S | 6/2020 | Glassman et al. | | |
| 2014/0091088 | A1 * | 4/2014 | Hay | B65F 1/02 | 220/676 |
| 2018/0319568 | A1 * | 11/2018 | Tye | B65D 7/08 | |
| 2020/0039680 | A1 | 2/2020 | Nowak et al. | | |

OTHER PUBLICATIONS

Youtube. Glueless Corrugated Tray Former. Published Jun. 29, 2021 by PolypackInc. Visited Mar. 1, 2022. https://www.youtube.com/watch?v=cN3oneedTVA (Year: 2021).

* cited by examiner

TRAY WITH NESTING ANTI-LOCK FEATURE

FIELD

This invention relates generally to containers for forming a nested stack of containers and, in particular, to a container configuration that includes features to limit wedging or locking engagement between adjacent containers during stacking of the containers.

BACKGROUND

Punnet trays or containers are well known to the industry for single use products, such as to package products such as, for example, fresh fruits and vegetables for retail distribution. The tray can generally comprise a bottom panel and a plurality of side wall panels that extend upwardly and slightly outwardly from the bottom panel so that a plurality of trays may be stacked in nested relation to each other to minimize or reduce the overall volume occupied by a package or group of such trays.

Conventionally, punnet trays may be formed of a plastic material wherein the trays can be formed with flanges for receiving a thin heat sealed film that may be transparent for visual presentation of the product. While forming the trays of a plastic materials permits the trays to be formed to a particular configuration, it is desirable to reduce the amount of plastic in such packaging. As an alternative form of packaging, trays can be formed of a fiber based material, such as a paperboard material, wherein the trays can be formed from a single sheet of material as a folded and glued tray. However, fiber based materials typically present challenges in producing a tray design that includes a rigid sealing flange, wherein the sealing flange is sufficiently rigid for the application of a seal film.

A process for creating the trays may rely on pressure between adjacent trays in a nested stack to apply pressure for a gluing step in assembly of the trays, that can force adjacent trays in the stack into tight engagement with one another. Further, jamming of the trays together during storage and transport of the tray stacks can make it difficult to pick a single tray out of the tray stack. The trays are conventionally used in processes that automatically fill each tray as the tray is picked out of a tray stack by a machine. Any trays jammed or interlocked with other trays can disrupt the filling process, which in turn can reduce the efficiency of the production process. Hence, there is a continuing need for a tray configuration formed from fiber based materials that permits space efficient stacking of a plurality of trays, while providing anti-lock characteristics for facilitating separation of individual trays from a stack during use in automated filling processes.

SUMMARY

In accordance with an aspect of the invention, a container is described comprising a bottom portion defining a base of the container, and a plurality of peripheral wall portions extending from the bottom portion and defining an interior area of the container. An upper edge of the container is defined by edges of the peripheral wall portions distal from the bottom portion. At least one peripheral wall portion has an inner surface including a feature defining an inner ledge extending into the interior area, the inner ledge being located between the bottom portion and the upper edge of the container. The at least one peripheral wall portion has an outer surface including a feature defining an outer ledge located between the bottom portion and the upper edge of the container. The inner ledge is positioned to engage the outer ledge of a similarly-configured container whereby a spacing between a stack of nested containers is defined by the outer ledge of the similarly-configured container seated on the inner ledge of the container.

The bottom portion may be generally planar, and the peripheral wall portions can each extend at an obtuse angle with respect to a plane defined by the bottom portion.

The peripheral wall portions can have a wall thickness and the inner ledge and outer ledge may have a thickness defined by the peripheral wall portions thickness.

The inner ledge may be defined on an inner flap forming a portion of the inner surface of the at least one peripheral wall portion.

The inner ledge may be defined on an edge of the inner flap at a junction with a further portion of the inner surface, the edge of the inner flap may face away from the bottom portion.

The further portion of the inner surface may be defined on a side wall panel hingedly joined to the bottom portion, and the inner flap may overlap and be adhesively attached to the side wall panel.

The inner flap may be hingedly attached to a further peripheral wall portion located adjacent to the at least one peripheral wall portion.

The outer ledge may be defined at an edge formed by a cut-out area on the side wall panel, the edge formed by the cut-out area may face toward the bottom portion.

The inner flap may overlap the cut-out area and form a portion of the outer surface of the at least one peripheral wall portion at the cut-out area, and the inner flap may fit within the cut-out area of the similarly-configured container when the similarly-configured container is nested within the container.

The inner flap may be hingedly attached to the bottom portion, and the further portion of the inner surface may be defined by at least one connection flap hingedly attached to at least one further peripheral wall portion located adjacent to the at least one peripheral wall portion.

The at least one connection flap may overlap the inner flap, and the outer ledge may be defined by an edge of the at least one connection flap that faces toward the bottom portion.

The at least one connection flap may comprise a pair of connection flaps attached to respective opposing further peripheral wall portions located adjacent to the at least one peripheral wall portion.

A flange may be provided at the upper edge of the container, the flange may be formed by flange portions hingedly attached to each of the plurality of peripheral wall portions, wherein the at least one peripheral wall portion may include a flange portion having tabs extending from opposing ends, wherein the tabs extend along portions of respective adjacent peripheral wall portions to form overlapping joints with flange portions of the respective adjacent peripheral wall portions.

In accordance with another aspect of the invention, a container is described formed from a one-piece blank of sheet material, the container comprising a generally planar bottom portion defining a base of the container, and opposing first and second peripheral wall portions, and opposing third and fourth peripheral wall portions extending between the first and second peripheral wall portions. Each of the peripheral wall portions extend from the bottom portion at an obtuse angle with respect to a plane defined by the bottom portion and defining an interior area of the container. An upper edge of the container is defined by edges of the peripheral wall portions distal from the bottom portion. The first and second peripheral wall portions having an inner surface including an inner flap defining an inner ledge extending into the interior area, the inner ledge being located between the bottom portion and the upper edge of the container. The first and second peripheral wall portions have an outer surface including a feature defining an outer ledge located between the bottom portion and the upper edge of the container. The inner ledges are positioned to engage the outer ledges of a similarly-configured container whereby a spacing between a stack of nested containers is defined by the outer ledges of the similarly-configured container seated on the inner ledges of the container.

The first and second peripheral wall portions may comprise respective side wall panels hingedly attached to the bottom portion, and the outer ledges may be defined at an edge formed by cut-out areas on the side wall panels, the edges formed by the cut-out areas may face toward the bottom portion.

The inner flaps may overlap respective cut-out areas and form portions of the outer surface of the first and second peripheral wall portions at the cut-out areas, and the inner flaps may fit within the cut-out areas of the similarly-configured container when the similarly-configured container is nested within the container.

The inner flaps may be hingedly attached to the bottom portion, and pairs of connection flaps may be hingedly attached to the third and fourth peripheral wall portions and overlap at least a portion of respective inner flaps, the outer ledges may be defined by edges of the connection flaps that face toward the bottom portion.

The first and second peripheral wall portions may comprise side walls of the container and the third and fourth peripheral wall portions may comprise end walls of the container.

The third and fourth peripheral wall portions may comprise side walls of the container and the first and second peripheral wall portions may comprise end walls of the container.

In accordance with a further aspect of the invention, a blank is described for forming a container, the blank comprising a bottom panel having opposing first and second longitudinal edges, and opposing lateral edges connecting the longitudinal edges. A pair of first side wall panels are hingedly attached to the bottom panel at the longitudinal edges, each first side wall panel including a pair of side edges that diverge from each other in a direction from the bottom panel toward an outer edge of the first side wall panel. A pair of second side wall panels are hingedly attached to the bottom panel at the lateral edges, each second side wall panel includes a pair of side edges that diverge from each other in a direction from the bottom panel toward an outer edge of the second side wall panel. A pair of connection flaps are hingedly attached to respective side edges of each of the second side wall panels.

A rectangular cut-out area may be defined in each of the side edges of the first side wall panels adjacent to the bottom panel, each rectangular cut-out area may be defined by a first cut-out edge extending from a respective longitudinal edge and a second cut-out edge extending from the first cut-out edge to a respective side edge.

The second cut-out edge may extend parallel to the respective longitudinal edge.

Each connection flap may include a lower portion defined between a lower edge extending from a junction between a longitudinal edge and a lateral edge and an upper edge parallel to the lower edge.

Each connection flap may include a triangular upper portion defined by an angled edge extending from the outer edge of the second side wall panel to the upper edge of the connection flap.

Flange portions may be hingedly attached to each of the first and second side wall panels, at least two of the flange portions may include opposing ends and tabs extending from the opposing ends in a direction perpendicular to a respective flange portion.

The connection flaps may comprise spaced, generally parallel upper and lower connection flap edges, and an intersection of each connection flap lower edge with a respective side edge may be spaced from a respective lateral edge of the bottom portion.

The upper and lower connection flap edges may extend at an acute angle relative to a respective side edge.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements.

DETAILED DESCRIPTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
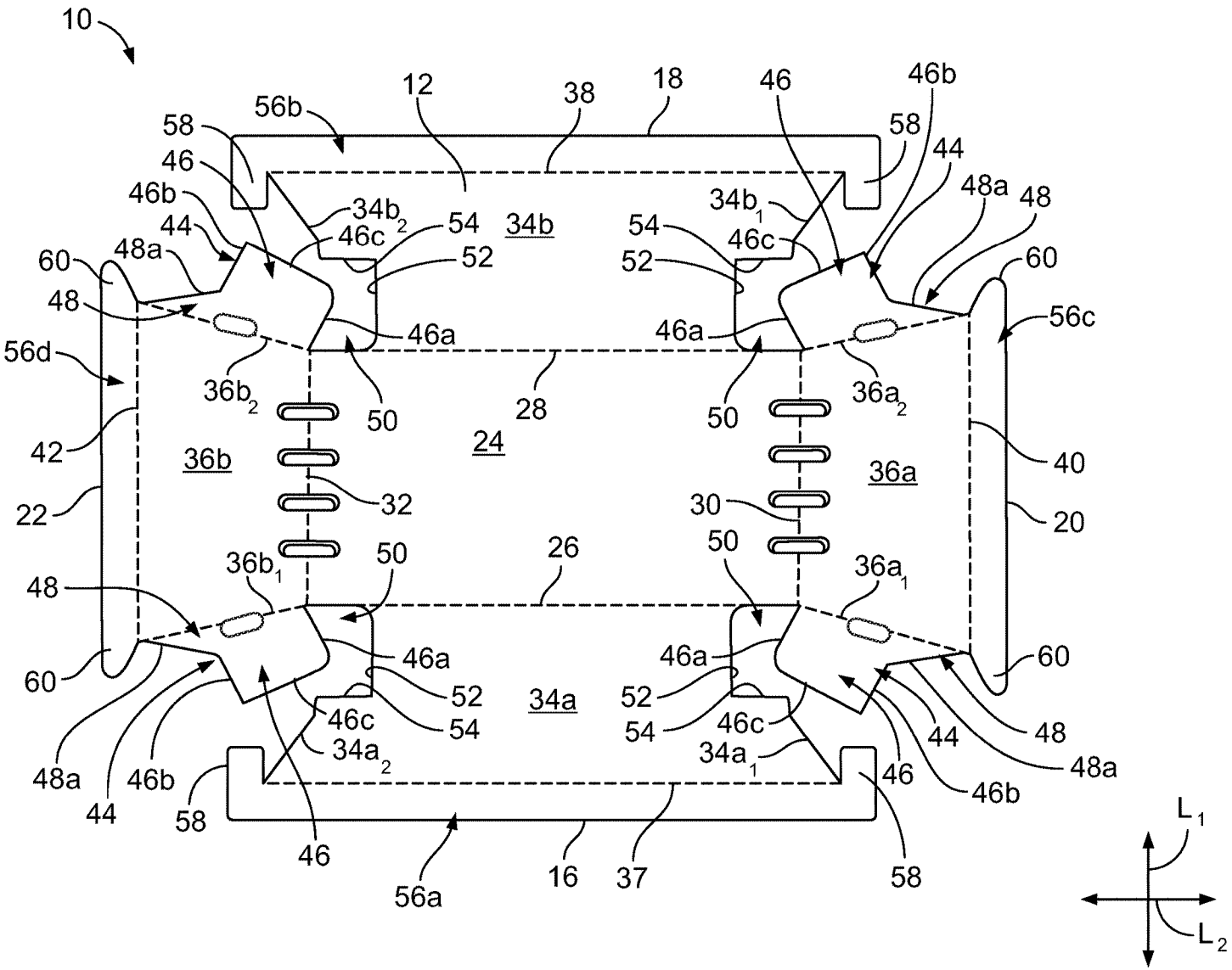
FIG. 1 is a plan view of a blank for use in forming a container as described herein.

Referring to FIG. 1, a die cut blank 10 is shown for illustrating one or more aspects of a container or tray comprising features for nest lock resistant, or anti-lock, nesting of plural similar containers or trays as described herein. The particular blank 10 illustrated herein comprises a one-piece blank of sheet material that can be used to form a container 8, see FIG. 2. The blank 10 may be formed of a corrugated paperboard material having an interior portion or layer defined by elongated flutes, as is generally known in the art, and may be die cut to the shape shown herein, although other materials and variations of the illustrated shape may be provided within the scope of the blank and container described herein, including other forms of fiber-based materials, e.g., other forms of paperboard such as cardboard and coated paperboard. The blank 10 illustrated in FIG. 1 is a planar piece of material in which an inner side 12 is shown facing out of the page and an outer side 14, see FIG. 2, faces in an opposite direction from the inner side 12.

As seen in FIG. 1, the blank 10 extends in a longitudinal direction $L_1$ between first and second longitudinal ends, generally designated 16 and 18, respectively, and further extends in a lateral direction $L_2$, perpendicular to the longitudinal direction $L_1$, between first and second lateral ends, generally designated 20 and 22, respectively.

The blank 10 comprises a bottom panel 24 having a generally rectangular shape including opposing longitudinal edges 26, 28, and opposing lateral edges, 30, 32 connecting the longitudinal edges 26, 28. A pair of first side wall panels 34*a*, 34*b* are hingedly attached to the bottom panel 24 at respective longitudinal edges 26, 28. The first side wall panel 34*a* includes a pair of opposing side edges 34$a_1$, 34$a_2$ that diverge from each other in a direction from the bottom panel 24 toward an outer edge 37 of the first side wall panel 34*a*. Similarly, the first side wall panel 34*b* includes a pair of opposing side edges 34$b_1$, 34$b_2$ that diverge from each other in a direction from the bottom panel 24 toward an outer edge 38 of the first side wall panel 34*b*.

A pair of second side wall panels 36*a*, 36*b* are hingedly attached to the bottom panel 24 at respective lateral edges 30, 32. The second side wall panel 36*a* includes a pair of opposing side edges 36$a_1$, 36$a_2$ that diverge from each other in a direction from the bottom panel 24 toward an outer edge 40 of the second side wall panel 36*a*. Similarly, the second side wall panel 36*b* includes a pair of opposing side edges 36$b_1$, 36$b_2$ that diverge from each other in a direction from the bottom panel 24 toward an outer edge 42 of the second side wall panel 36*b*.

A pair of connection flaps 44, also referred to as inner flaps, are hingedly attached to respective opposing side edges 36$a_1$, 36$a_2$, 36$b_1$, 36$b_2$ of the second side wall panels 36*a*, 36*b*, wherein each connection flap 44 includes a lower portion 46 defined between a lower edge 46*a* extending from a junction between a respective longitudinal edge 26, 28 and a respective lateral edge 30 32, and an upper edge 46*b* parallel to, or generally parallel to, the lower edge 46*a*. The upper and lower edges 46*a*, 46*b* of the lower portions 46 extend at an acute angle relative to respective side edges 36$a_1$, 36$a_2$, 36$b_1$, 36$b_2$, as measured in a direction angled toward the bottom portion 24. Each connection flap 44 further includes a triangular upper portion 48 defined by an angled edge 48*a* extending from a respective outer edge 40, 42 of the second side wall panel 36*a*, 36*b* to the upper edge 46*b* of the lower portion 46.

A pair of cut-out areas 50 are defined in each of the first side walls 34*a*, 34*b*, wherein the cut-out areas 50 can comprise a rectangular, or generally rectangular area defined in each side edge 34$a_1$, 34$a_2$, 34$b_1$, 34$b_2$ of the first side walls 34*a*, 34*b*. Each rectangular cut-out area 50 is defined by a first cut-out edge 52 extending from a respective longitudinal edge 26, 28, wherein the first cut-out edge 52 is oriented perpendicular to, or generally perpendicular to, the respective longitudinal edge 26, 28. Each cut-out area 50 is further defined by a second cut-out edge 54 extending from a respective first cut-out edge 52 to a respective side edge 34$a_1$, 34$a_2$, 34$b_1$, 34$b_2$, wherein the second cut-out edge 54 is oriented perpendicular to, or generally perpendicular to, a respective first cut-out edge 52. The second cut-out edges 54 may be parallel to and face toward respective longitudinal edges 26, 28 of the bottom panel 24. A further side of the rectangular cut-out area 50 may comprise an open side defined by imaginary line extensions (not shown) of respective lateral edges 30, 32 of the bottom panel 24 extending parallel to the first cut-out edges 52.

First flange portions 56*a*, 56*b* are hingedly attached to the first side wall panels 34*a*, 34*b* at respective outer edges 37, 38 of the first side wall panels 34*a*, 34*b*. Similarly, second flange portions 56*c*, 56*d* are hingedly attached to the second side wall panels 36*a*, 36*b* at respective outer edges 40, 42 of the second side wall panels 36*a*, 36*b*. The first flange portions 56*a*, 56*b* include tabs 58 at opposing longitudinal ends of the flange portions 56*a*, 56*b*, wherein the tabs extend adjacent to respective side edges 34$a_1$, 34$a_2$, 34$b_1$, 34$b_2$, perpendicular to the longitudinal length of a respective flange portion 56*a*, 56*b*. The second flange portions 56*c*, 56*d* include extension portions 60 that extend longitudinally, i.e., along the length of the second flange portions 56*c*, 56*d*, beyond respective side edges 36$a_1$, 36$a_2$ and 36$b_1$, 36$b_2$ of the second side walls 36*a*, 36*b*.

Figure 2:
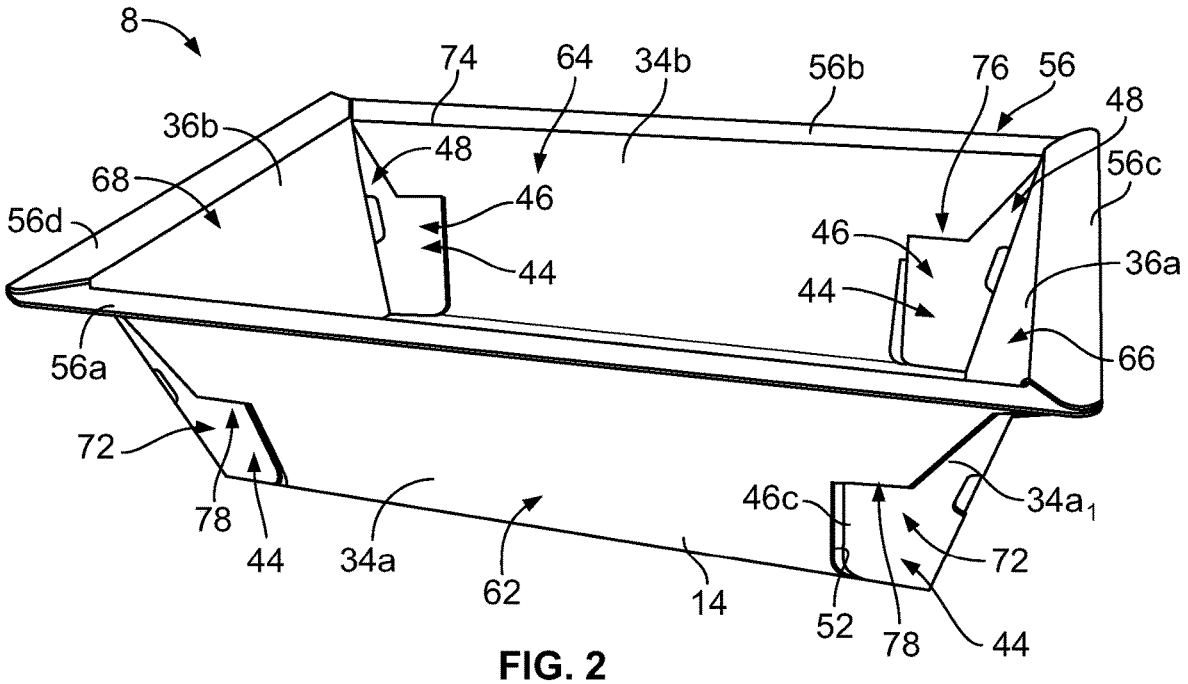
FIG. 2 is a perspective view of a container formed from the blank of FIG. 1.

Referring to FIGS. 1 and 2, in a use of the blank 10 to form a container 8, the first and second side wall panels 34*a*, 34*a* and 36*a*, 36*b* are pivoted upward relative to the bottom panel 24 at the respective longitudinal and lateral edges 26, 28 and 30, 32 to form a plurality of peripheral wall portions. In particular, the bottom panel 24 comprises a planar bottom portion forming a base for the container 8, and opposing first and second peripheral wall portions 62, 64 are formed by the connection flaps 44, comprising inner flaps, pivoted perpendicular to the second side wall panels 36*a*, 36*b* to define a first portion of the first and second peripheral wall portions 62, 64, and the first side wall panels 34*a*, 34*b* forming a second or further portion of the first and second peripheral wall portions 62, 64. The second side wall panels 36*a*, 36*b* form opposing third and fourth peripheral wall portions 66, 68.

Figure 3:
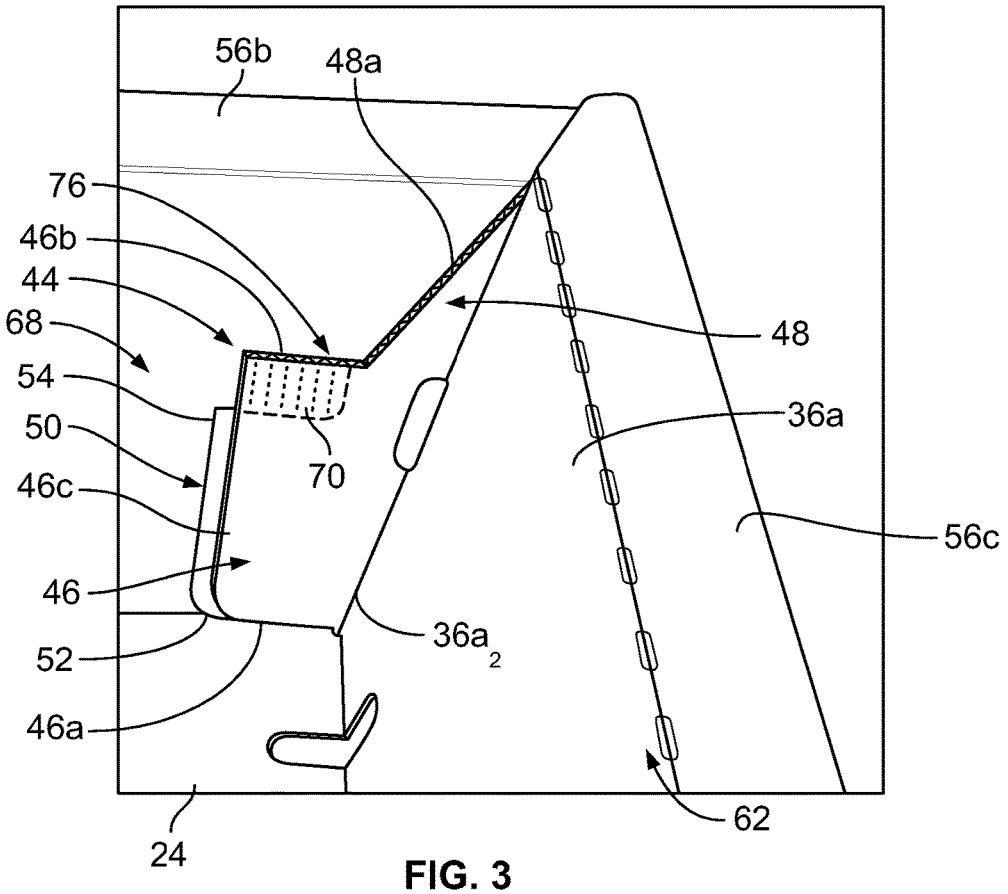
FIG. 3 is an enlarged interior view of the container of FIG. 2 illustrating an inner ledge feature for the container.

The connection flaps 44 partially overlap and can be adhered to an inner surface of respective first side wall panels 34*a*, 34*b*. For example, the lower portions 46 of the connection flaps 44 can overlap the respective first side wall panel 34*a*, 34*b* above the second cut-out edge 54 of the cut-out area 50, as seen in FIG. 3, with distal edges 46*c* of the lower portions 46 located adjacent to the first cut-out edge 52. An adhesive may be applied in an area of contacting overlap between the connection flaps 44 and the first side wall panels 34*a*, 34*b*, as is generally depicted by adhesive area 70 in FIG. 3, to form corner joints between adjacent peripheral wall portions 62, 64 and 66, 68. Each of the peripheral wall portions 62, 64, 66, 68 extends from the bottom panel 24 at an obtuse angle with respect to a plane defined by the bottom panel 24 to form an upwardly expanding interior area of the container 8.

Figure 4:
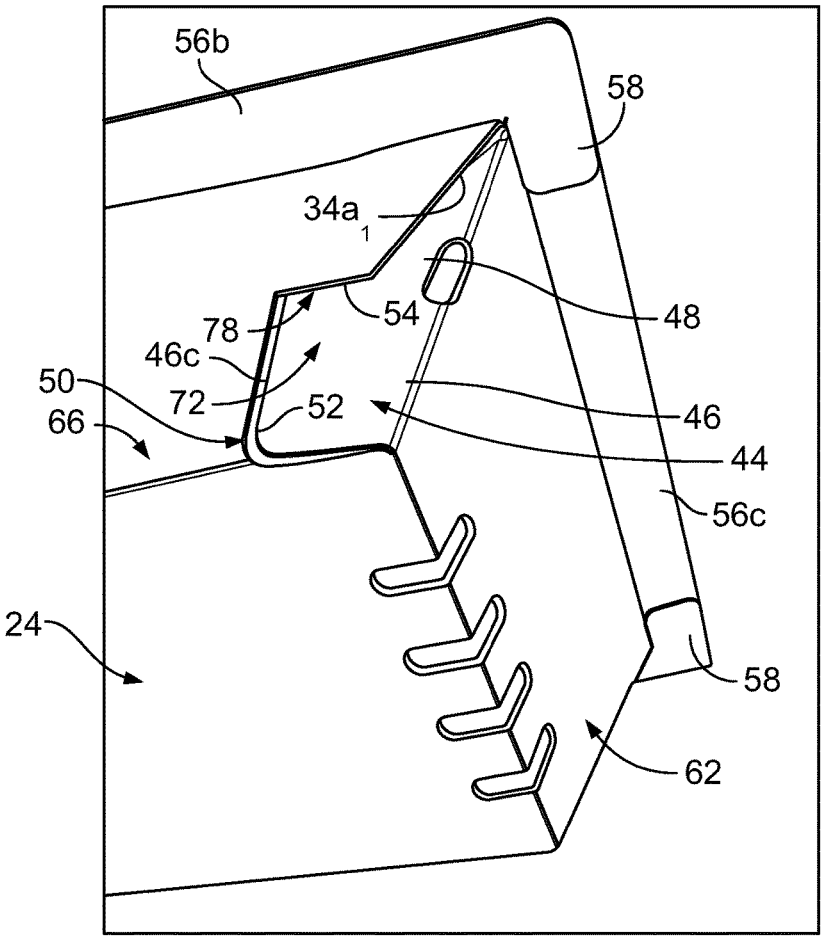
FIG. 4 is an enlarged exterior view of the container of FIG. 2 illustrating an outer ledge feature for the container.

It may be understood that the upper and lower portions 46, 48 of each connection flap 44 extend in overlapping relationship across a cut-out opening 72 defining a cut-out area in a respective first side wall panel 34*a*, 34*b* formed by a cut-out area 50 and a triangular cut-out area defined by an adjacent diverging or angled side edge 34$a_1$, 34$a_2$, 34$b_1$, 34$b_2$, wherein the connection flap 44 has a configuration that generally corresponds to the cut-out opening 72, see FIGS. 2 and 4.

The first flange portions 56*a*, 56*b* and second flange portions 56*c*, 56*d* are pivoted outward from the respective first and second side wall panels 34*a*, 34*b* and 36*a*, 36*b* to form a planar flange 56, parallel to and distal from the bottom panel 24 at an upper edge 74 of the container 8. As the first flange portions 56*a*, 56*b* are pivoted outward, the tabs 58 are pivoted to overlapping relationship beneath the extension portions 60 of the second flange portions 56*c*, 56*d*, see FIG. 4. The tabs 58 may be adhered to the extension portions 60 in the area of overlap to form the flange 56 as continuous member around the periphery of the upper edge 74, and further strengthening the connections between the peripheral wall portions 62, 64 and 66, 68, see FIG. 2. The flange 56 may form a generally planar rigid sealing surface, such as for sealingly receiving a film or cover to seal a product within the container 8.

Each connection flap 44 defines a respective feature on the inner surface of the container 8 comprising an inner ledge 76 located between the bottom panel 24 and the upper edge 74 of the container 8, see FIG. 3. In particular, each inner ledge 76 is formed by the upper edge 46*b* of the lower portion 46 of connection flap 44 facing away from the bottom panel 24 at a junction with a further portion of the inner surface, i.e., at a junction with a further portion defined by an inner surface on a respective first side wall panel 34*a*, 34*b*, and extending inward from the further portion of the inner surface into the interior area of the container 8. A thickness $T_1$ or width of the inner ledge 76, see FIG. 6, is defined by the thickness of the material forming the peripheral wall portions, i.e., equal to the thickness of the material of the connection flap 44.

The outer surfaces of the first and second peripheral wall portions 62, 64 include features defining an outer ledge 78 located between the bottom panel 24 and the upper edge 74 of the container 8, see FIG. 4. In particular, each outer ledge 78 is defined by a second cut-out edge 54 of the cut-out area 50 facing toward the bottom panel 24 at a junction of the connection flap 44 with a respective first side wall panel 34*a*, 34*b*, wherein the outer ledge 78 extends outward from the exterior surface of the container 8 defined on the connection flap 44 at the cut-out area 72. A thickness or width of the outer ledge 78, see FIG. 6, is defined by the thickness $T_2$ of the material forming the peripheral wall portions, i.e., equal to the thickness of the material of the first side wall panels 34*a*, 34*b*, wherein the thicknesses $T_1$, $T_2$ are typically the same and are equal to the thickness of the blank 10.

The inner and outer ledges 76, 78 located at respective corner joints are generally adjacent to and vertically spaced from each other on opposing interior and exterior sides of the respective first side wall panels 34*a*, 34*b*. The vertical spacing between the inner and outer ledges 76, 78 corresponds to the vertical overlap of the lower portion 46 of each connection flap 44 with a respective first side wall panel 34*a*, 34*b*, i.e., at the adhesive area 70.

Figure 5:
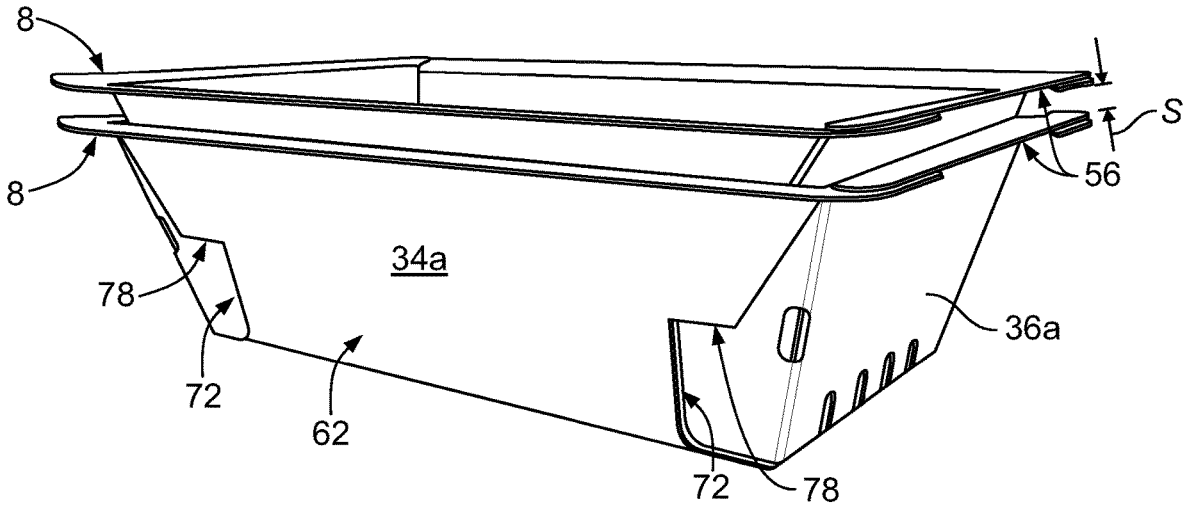
FIG. 5 is a perspective view illustrating a stack of nested containers formed using the container of FIG. 2.
Figure 6:
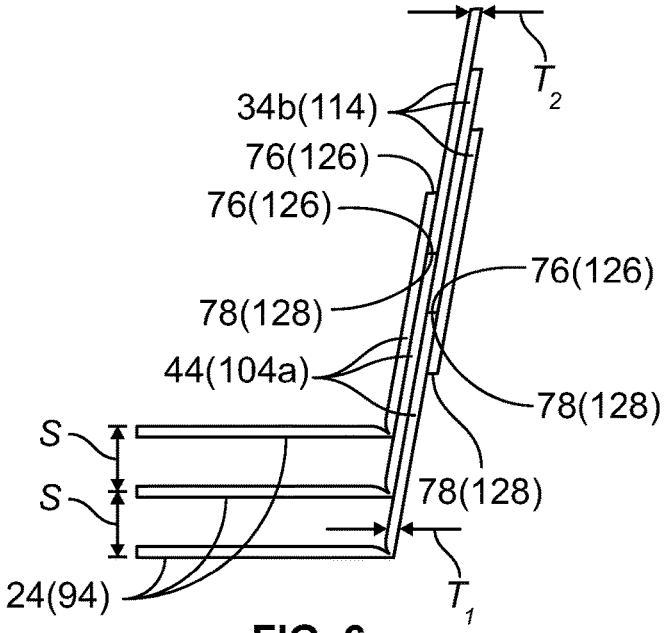
FIG. 6 is a diagrammatic section view taken through a stack of similarly configured nested containers, corresponding to the embodiments described herein, and illustrating a spacing between the containers defined by engagement between inner and outer ledge features.

The inner ledge 76 of the container 8 is positioned to engage the outer ledge 78 of a similarly-configured container 8 whereby a spacing S between a stack of nested containers 8 is defined by the outer ledge 78 of the similarly-configured container 8 seated on the inner ledge 76 of the container 8, see FIGS. 5 and 6. In particular, the outer ledge 78 of an inner container 8 engages the inner ledge 76 of an adjacent outer container 8 that the inner container 8 is inserted or nested into, to thereby define a predetermined stop position between the containers 8, limiting wedging or locking engagement during stacking of the adjacent containers 8.

It may be noted that the cut-out openings 72 on the exterior of the containers 8 have substantially the same shape or configuration as the connection flaps 44 on the interior of the containers 8, such that the interface location for the inner ledge 76 to engage the outer ledge 78 does not require the overlap of more than one material thickness per each of the two containers 8. Hence, although the connection flaps 44 overlap the respective first side wall panels 34*a*, 34*b* at the adhesive areas 70, an interiorly nested container 8 includes the cut-out opening 72 that receives the connection flap 44, including the overlapping adhesive area 70, which further avoids wedging engagement between the nested containers 8 that might otherwise occur as a result of engagement with plural layers of material thickness. As noted above, the vertical dimension of the overlapping adhesive area 70, i.e., the vertical spacing between the inner and outer ledges 76, 78 of the container 8, define the vertical spacing S between the nested containers 8 to limit or prevent wedging engagement.

It should be understood that although the anti-lock features for limiting or preventing wedging engagement between the nested containers 8 are described as being associated with the first and second peripheral wall portions 62, 64, which may comprise side walls of the container 8, the container 8 may alternatively be configured in a similar manner to that described above with the anti-lock features, as described above, configured to be associated with the third and fourth peripheral wall portions 66, 68, which may comprise end walls of the container 8. Such an alternative construction for the container 8 would operate in the same manner as described above to limit or prevent wedging engagement between nested containers.

As may be understood from the above description, the container 8 is configured with a flange 56 formed as a glued structure interconnecting the adjacent flange portions 56*a-d*, wherein the flange 56 defines a rigid planar surface at the upper edge 74 of the container 8 for receiving a seal film. The container 8 also provides features, as defined by the inner and outer ledges 76, 78, defining an anti-lock structure that allows the container 8, and similarly configured containers 8, to be nested together at a predetermined spacing, which can facilitate separation of individual containers 8 from a stack of containers 8. Further, it may be understood that the discrete adhesive areas 70 joining the peripheral wall portions 62, 64, 66, 68, and the overlapping areas of adhesive attachment between the flange tabs 58 and the flange extension portions 60, may be separated to facilitate breakdown and recycling of the container 8 following use of the container 8.

Figure 7:
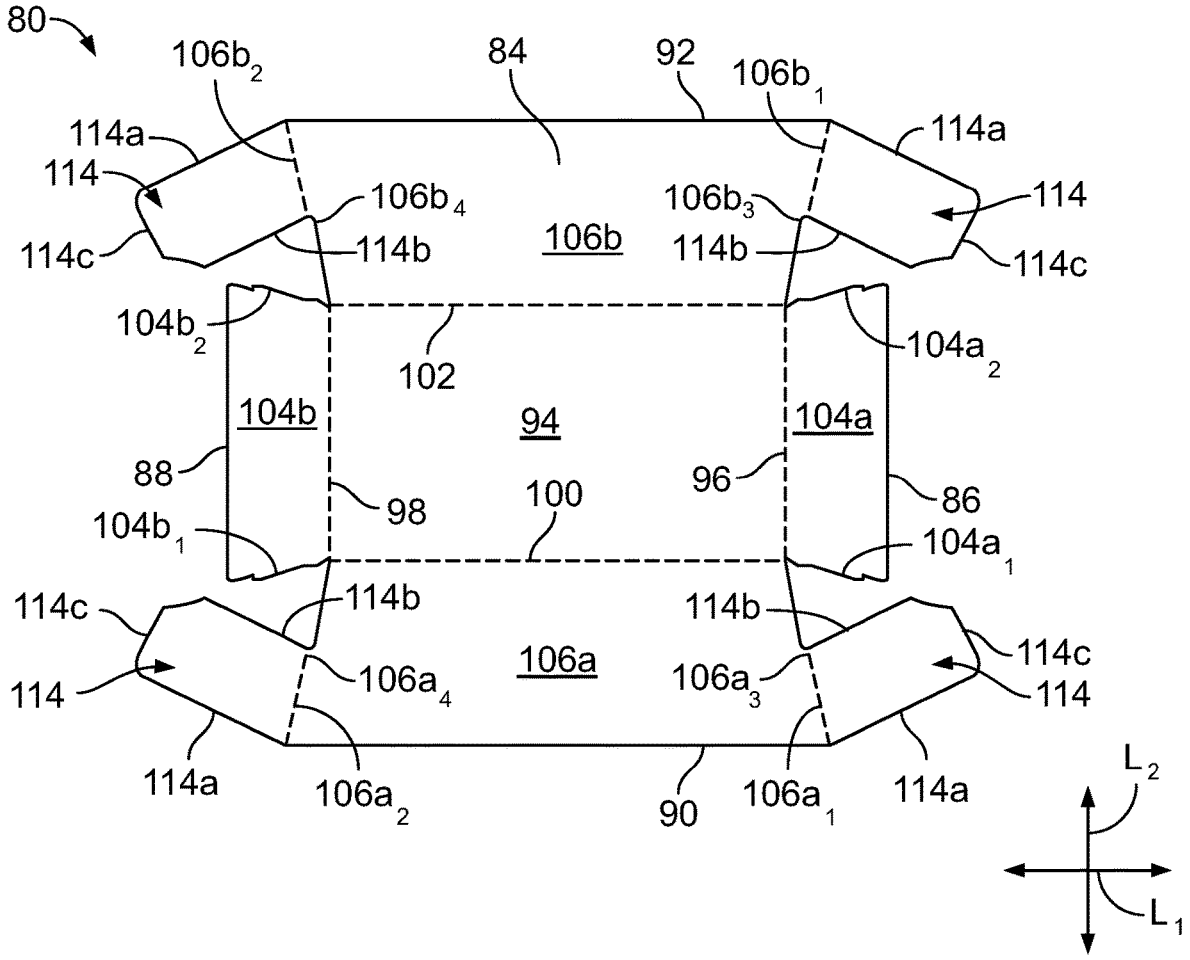
FIG. 7 is a plan view of an alternative blank for use in forming a further embodiment of a container as described herein.
Figure 8:
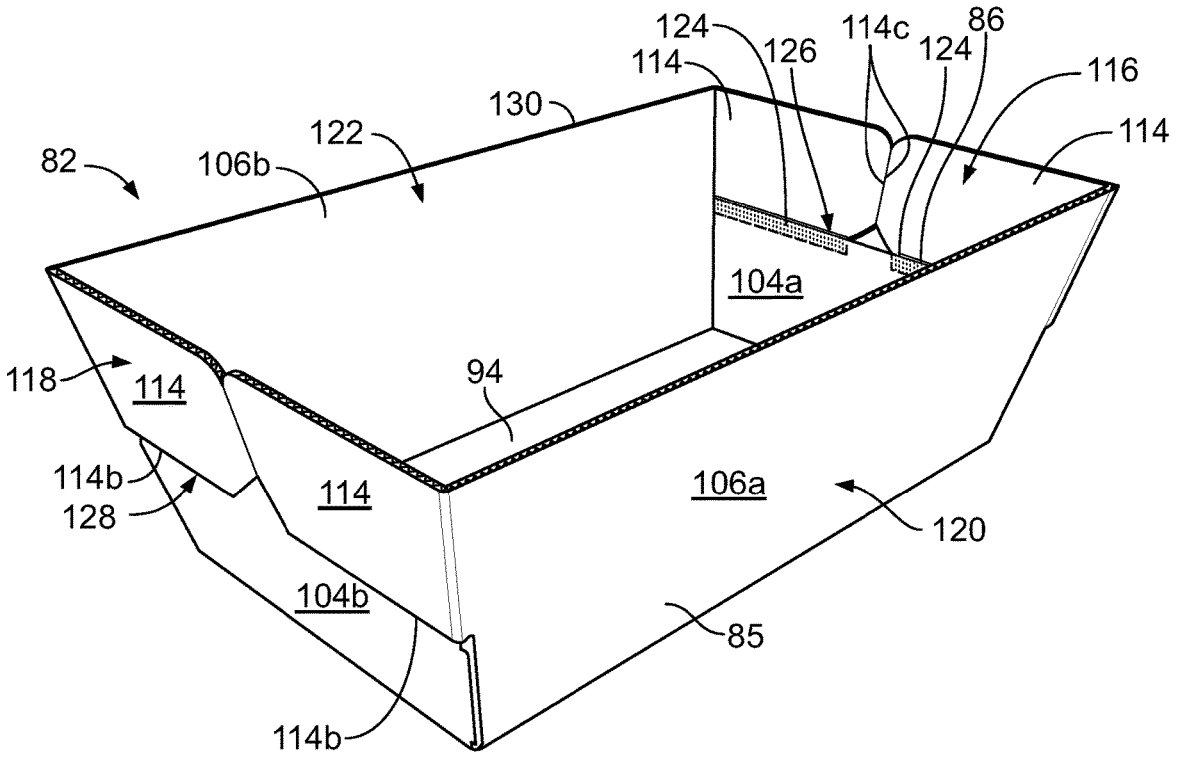
FIG. 8 is a perspective view of a container formed from the blank of FIG. 7.
Figure 9:
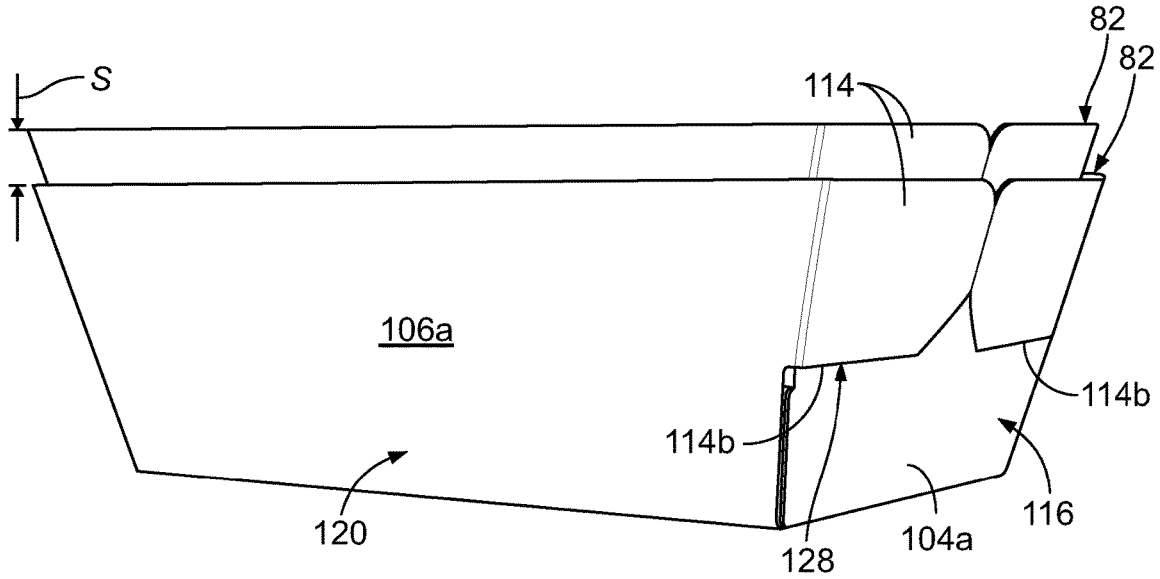
FIG. 9 is a perspective view illustrating a stack of nested containers formed using the container of FIG. 8.

FIGS. 7-9 illustrate an alternative configuration for a blank and nested container with anti-lock features. Referring initially to FIG. 7, a die cut blank 80 is shown for illustrating one or more aspects of a container or tray comprising features for nest lock resistant, or anti-lock, nesting of plural similar containers or trays as described herein. The particular blank 80 illustrated herein comprises a one-piece blank of sheet material that can be used to form a container 82, see FIG. 8. The blank 80 may be formed of a corrugated paperboard material having an interior portion or layer defined by elongated flutes, as is generally known in the art, and may be die cut to the shape shown herein, although other materials and variations of the illustrated shape may be provided within the scope of the blank and container described herein, including other forms of fiber based materials, e.g., other forms of paperboard such as cardboard or coated paperboard. The blank 80 illustrated in FIG. 7 is a planar piece of material in which an inner side 84 is shown facing out of the page and an outer side 85, see FIG. 8, faces in an opposite direction from the inner side 84.

As seen in FIG. 7, the blank 80 extends in a longitudinal direction $L_1$ between first and second longitudinal ends, generally designated 86 and 88, respectively, and further extends in a lateral direction $L_2$, perpendicular to the longitudinal direction $L_1$, between first and second lateral ends, generally designated 90 and 92, respectively.

The blank 80 comprises a bottom panel 94 having a generally rectangular shape including opposing longitudinal edges 96, 98, and opposing lateral edges, 100, 102 connecting the longitudinal edges 96, 98. A pair of first side wall panels 104*a*, 104*b*, also referred to as inner flaps, are hingedly attached to the bottom panel 94 at respective longitudinal edges 96, 98. The first side wall panel 104*a* includes a pair of opposing side edges 104$a_1$, 104$a_2$ that diverge from each other in a direction from the bottom panel 94 toward an outer edge of the first side wall panel 104*a* corresponding to the longitudinal edge 86. Similarly, the first side wall panel 104*b* includes a pair of opposing side edges 104$b_1$, 104$b_2$ that diverge from each other in a direction from the bottom panel 94 toward an outer edge of the first side wall panel 104*b* corresponding to the longitudinal edge 88.

A pair of second side wall panels 106*a*, 106*b* are hingedly attached to the bottom panel 94 at respective lateral edges 100, 102. The second side wall panel 106*a* includes a pair of opposing side edges 106$a_1$, 106$a_2$ that diverge from each other in a direction from the bottom panel 94 toward an outer edge of the second side wall panel 106*a* corresponding to the lateral edge 90. Similarly, the second side wall panel 106*b* includes a pair of opposing side edges 106$b_1$, 106$b_2$ that diverge from each other in a direction from the bottom panel 94 toward an outer edge of the second side wall panel 106*b* corresponding to the lateral edge 92.

A pair of connection flaps 114 are hingedly attached to respective opposing side edges 106$a_1$, 106$a_2$, 106$b_1$, 106$b_2$ of the second side wall panels 106*a*, 106*b*. Each connection flap 114 includes spaced parallel, or generally parallel, upper and lower connection flap edges 114*a*, 114*b*, wherein the connection flap edges 114*a*, 114*b* extend at an acute angle relative to a respective side edge 106$a_1$, 106$a_2$, 106$b_1$, 106$b_2$, as measured in a direction angled toward the bottom panel 94. Each lower connection flap edge 114*b* extends from an intersection or junction 106$a_3$, 106$a_4$, 106$b_3$, 106$b_4$ with a respective side edge 106$a_1$, 106$a_2$, 106$b_1$, 106$b_2$, wherein the junctions 106$a_3$, 106$a_4$ and 106$b_3$, 106$b_4$ are spaced from respective lateral edges 100, 102 of the bottom panel 94.

Referring to FIGS. 7 and 8, in a use of the blank 80 to form a container 82, the first and second side wall panels 104*a*, 104*a* and 106*a*, 106*b* are pivoted upward relative to the bottom panel 94 at the respective longitudinal and lateral edges 96, 98 and 100, 102 to form a plurality of peripheral wall portions. In particular, the bottom panel 94 comprises a planar bottom portion forming a base for the container 82, and opposing first and second peripheral wall portions 116, 118 are formed by the first side wall panels 104*a*, 104*b*, comprising inner flaps, defining a first portion of the first and second peripheral wall portions 116, 118, and by the connection flaps 114 pivoted perpendicular to the second side wall panels 106*a*, 106*b*, positioning distal edges 114*c* of the connection flaps 114 adjacent to each other, to form a second or further portion of the first and second peripheral wall portions 116, 118. The second side wall panels 106*a*, 106*b* form opposing third and fourth peripheral wall portions 120, 122.

The connection flaps 114 partially overlap and can be adhered to an outer surface of respective first side wall panels 104*a*, 104*b*. For example, a lower portion of the connection flaps 114 can overlap an upper edge of the respective first side wall panel 104*a*, 104*b*, as seen in FIG. 8. An adhesive may be applied in an area of contacting overlap between the connection flaps 114 and the first side wall panels 104*a*, 104*b*, as is generally depicted by adhesive area 124 in FIG. 8, to form a connection joining adjacent peripheral wall portions 116, 118 and 120, 122. Each of the peripheral wall portions 116, 118, 120, 122 extends from the bottom panel 94 at an obtuse angle with respect to a plane defined by the bottom panel 94 to form an upwardly expanding interior area of the container 82.

The inner surfaces of the first and second peripheral wall portions 116, 118 include features defining inner ledges 126 located between the bottom panel 94 and an upper edge 130 of the container 82. In particular, the longitudinal outer edges 86, 88 of the respective first side wall panels 104*a*, 104*b* define the inner ledges 126 on the inner surfaces of the first and second peripheral wall portions 116, 118 of the container 82, wherein the ledges 126 face away from the bottom panel 94 at a junction with a further portion of the inner surface of the container 82, i.e., at a junction with a further portion defined by an inner surface on respective connection flaps 114, and extending inward from the further portion of the inner surface into the interior area of the container 82. A thickness $T_1$ or width of the inner ledge 126, see FIG. 6, is defined by the thickness of the material forming the peripheral wall portions, i.e., equal to the thickness of the material of the first side wall panels 104*a*, 104*b*.

The outer surfaces of the first and second peripheral wall portions 116, 118 include features defining an outer ledge 128 located between the bottom panel 94 and the upper edge 130 of the container. In particular, each outer ledge 128 is defined by the lower edges 114*b* of the connection flaps 114 facing toward the bottom panel 94 at junctions with the first side wall panels 104*a*, 104*b*, wherein the outer ledge 128 extends outward from the exterior surface of the container 82 defined on the first side wall panels 104*a*, 104*b*. A thickness or width of the outer ledge 128, see FIG. 6, is defined by the thickness $T_2$ of the material forming the peripheral wall portions, i.e., equal to the thickness of the material of the connection flaps 114, wherein the thicknesses $T_1$, $T_2$ are typically the same and are equal to the thickness of the blank 80.

The inner and outer ledges 126, 128 are vertically spaced from each other on opposing interior and exterior sides of the respective first and second peripheral wall portions 116, 118. The vertical spacing between the inner and outer ledges 126, 128 corresponds to the vertical overlap of the first side wall panels 104*a*, 104*b* with respective connection flaps 114, i.e., at the adhesive areas 124.

The inner ledge 126 of the container 82 is positioned to engage the outer ledge 128 of a similarly-configured container 82 whereby a spacing S between a stack of nested containers 82 is defined by the outer ledge 128 of the similarly-configured container 82 seated on the inner ledge 126 of the container 82, see FIGS. 6 and 9. In particular, the outer ledge 128 of an inner container 82 engages the inner ledge 126 of an adjacent outer container 82 that the inner container 82 is inserted or nested into, to thereby define a predetermined stop position between the containers 82, limiting wedging or locking engagement during stacking of the adjacent containers 82.

It may be noted that in a nested stack of containers 82, a recessed area is defined above the inner ledge 126 and adjacent to the inner surface of the connection flaps 114 of an outer container 82 for receiving the connection flaps 114 of an inner container 82. The interface location where the inner ledge 126 engages the outer ledge 128 does not require the overlap of more than one material thickness per each of the two containers 82. Hence, although the connection flaps 114 overlap the respective first side wall panels 104*a*, 104*b* at the adhesive areas 124, an interiorly nested container 82 includes a recessed area below the outer ledges 128 that receives the respective first side wall panels 104*a*, 104*b*, which is unaffected by the overlapping adhesive area 124, and which further avoids wedging engagement between the nested containers 82 that might otherwise occur as a result of engagement with plural layers of material thickness. As noted above, the vertical dimension of the overlapping adhesive area 124, i.e., the vertical spacing between the inner and outer ledges 126, 128 of the container 82, define the vertical spacing S between the nested containers 82 to limit or prevent wedging engagement.

It should be understood that although the anti-lock features for limiting or preventing wedging engagement between the nested containers 82 are described as being associated with the first and second peripheral wall portions 116, 118, which may comprise end walls of the container 82, the container 82 may alternatively be configured in a similar manner to that described above with the anti-lock features, as described above, configured to be associated with the third and fourth peripheral wall portions 120, 122, which may comprise side walls of the container 82. Such an alternative construction for the container 82 would operate in the same manner as described above to limit or prevent wedging engagement between nested containers.

As may be understood from the above description, the container 82 provides features, as defined by the inner and outer ledges 126, 128, forming an anti-lock structure that allows the container 82, and similarly configured containers 82, to be nested together at a predetermined spacing, which can facilitate separation of individual containers 82 from a stack of containers 82. Further, it may be understood that the discrete adhesive areas 124 joining the peripheral wall portions 116, 118, 120, 122, i.e., at the overlap between the first side wall panels 104*a*, 104*b* and the connection flaps 114, may be separated to facilitate breakdown and recycling of the container 82 following use of the container 82.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container comprising:

a bottom portion defining a base of the container;

a plurality of peripheral wall portions extending from the bottom portion and defining an interior area of the container;

an upper edge of the container defined by edges of the peripheral wall portions distal from the bottom portion;

at least one peripheral wall portion comprising a first peripheral wall portion comprising a first wall panel and a first flap in contact with the wall panel, one of the flap or the wall panel including a feature defining an inner ledge extending into the interior area, the inner ledge located between the bottom portion and the upper edge of the container;

the other of the wall panel or flap including a feature defining an outer ledge located between the bottom portion and the upper edge of the container; and the inner ledge being positioned to engage an outer ledge of a similarly-configured container whereby a spacing between a stack of nested containers is defined by the outer ledge of the similarly-configured container seated on the inner ledge of the container;

wherein the first wall panel defines a side wall panel hingedly joined to the bottom portion, the outer ledge is defined at an edge formed by a cut-out area on the side wall panel, the cut-out area being defined by a first cut-out edge extending from a longitudinal edge of the bottom portion, a second cut-out edge extending from and oriented generally perpendicular to the first cut-out edge and an open side defined by an imaginary line extending from a lateral edge of the bottom portion, the edge formed by the cut-out area facing toward the bottom portion.

2. The container as set forth in claim 1, wherein the bottom portion is generally planar, and the peripheral wall portions each extend at an obtuse angle with respect to a plane defined by the bottom portion.

3. The container as set forth in claim 1, wherein the flap has a wall thickness and the inner ledge has a thickness defined by the flap wall thickness.

4. The container as set forth in claim 1, wherein the flap defines an inner flap forming a portion of the first peripheral wall portion.

5. The container as set forth in claim 4, wherein the inner ledge is defined on an edge of the inner flap at a junction with the wall panel, the edge of the inner flap facing away from the bottom portion.

6. The container as set forth in claim 5, wherein the inner flap overlaps and is adhesively attached to the side wall panel.

7. The container as set forth in claim 6, wherein the inner flap is hingedly attached to a further peripheral wall portion located adjacent to the first peripheral wall portion.

8. The container as set forth in claim 6, wherein the inner flap overlaps the cut-out area and forms a portion of an outer surface of the first peripheral wall portion at the cut-out area, and the inner flap fits within a cut-out area of the similarly-configured container when the similarly-configured container is nested within the container.

9. The container as set forth in claim 1, wherein the wall panel defines an inner flap hingedly attached to the bottom portion, and the first flap is defined by at least one connection flap hingedly attached to at least one further peripheral wall portion located adjacent to the first peripheral wall portion.

10. The container as set forth in claim 9, wherein the at least one connection flap overlaps the inner flap, and the outer ledge is defined by an edge of the at least one connection flap that faces toward the bottom portion.

11. The container as set forth in claim 10, wherein the at least one connection flap comprises a pair of connection flaps attached to respective opposing further peripheral wall portions located adjacent to the first peripheral wall portion.

12. The container as set forth in claim 1, including a flange at the upper edge of the container, the flange formed by flange portions hingedly attached to each of the plurality of peripheral wall portions, wherein each peripheral wall portion includes a flange portion having tabs extending from opposing ends, wherein the tabs extend along portions of respective adjacent peripheral wall portions to form overlapping joints with flange portions of the respective adjacent peripheral wall portions.

13. The container as set forth in claim 1, wherein the wall panel and the flap have substantially the same thickness.

14. The container as set forth in claim 1, wherein the first cut-out edge is generally perpendicular to the longitudinal edge of the bottom portion.

15. A container formed from a one-piece blank of sheet material, the container comprising:

a generally planar bottom portion defining a base of the container;

opposing first and second peripheral wall portions, and opposing third and fourth peripheral wall portions extending between the first and second peripheral wall portions, each of the peripheral wall portions extending from the bottom portion at an obtuse angle with respect to a plane defined by the bottom portion and defining an interior area of the container;

an upper edge of the container defined by edges of the peripheral wall portions distal from the bottom portion;

the first and second peripheral wall portions comprising an inner flap defining an inner ledge extending into the interior area, the inner ledge located between the bottom portion and the upper edge of the container;

the first and second peripheral wall portions comprising a side wall panel, wherein the side wall panel defining an outer ledge located between the bottom portion and the upper edge of the container, the side wall panel hingedly joined to the bottom portion, the outer ledge is defined at an edge formed by a cut-out area on the side wall panel, the cut-out area being defined by a first cut-out edge extending from a longitudinal edge of the bottom portion, a second cut-out edge extending from and oriented generally perpendicular to the first cut-out edge and an open side defined by an imaginary line extending from a lateral edge of the bottom portion, the edge formed by the cut-out area facing toward the bottom portion; and the inner ledges being positioned to engage outer ledges of a similarly-configured container whereby a spacing between a stack of nested containers is defined by the outer ledges of the similarly-configured container seated on the inner ledges of the container.

16. The container as set forth in claim 15, wherein the inner flaps overlap the respective cut-out areas and form portions of an outer surface of the first and second peripheral wall portions at the cut-out areas, and the inner flaps fit within cut-out areas of the similarly-configured container when the similarly-configured container is nested within the container.

17. The container as set forth in claim 15, wherein the inner flaps are hingedly attached to the bottom portion, and the one of a wall panel or a further flap of each of the first and second peripheral wall portions comprises a connection flap, the connection flaps of the first and second peripheral wall portions are hingedly attached to the third and fourth peripheral wall portions and overlap at least a portion of respective inner flaps, the outer ledges are defined by edges of the connection flaps that face toward the bottom portion.

18. The container as set forth in claim 15, wherein the first and second peripheral wall portions comprise side walls of the container and the third and fourth peripheral wall portions comprise end walls of the container.

* * * * *